US008251754B2

(12) United States Patent
Tai et al.

(10) Patent No.: US 8,251,754 B2
(45) **Date of Patent: *Aug. 28, 2012**

(54) POWER CONNECTOR WITH IMPROVED LOCKING MEMBER EXPOSED TO THE EXTERIOR

(75) Inventors: Hung-Chi Tai, Jhonghe (TW); Zhi-Qiang Rong, Taicang (CN)

(73) Assignee: Alltop Electronics (Suzhou) Ltd, Taicang (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/287,272

(22) Filed: Nov. 2, 2011

(65) Prior Publication Data

US 2012/0045945 A1 Feb. 23, 2012

Related U.S. Application Data

(63) Continuation of application No. 12/939,027, filed on Nov. 3, 2010, now Pat. No. 8,070,533.

(30) Foreign Application Priority Data

Jul. 9, 2010 (CN) ..... 2010 1 0223665

(51) Int. Cl.
*H01R 24/00* (2006.01)

(52) U.S. Cl. ..... 439/681

(58) Field of Classification Search ..... 439/682, 439/680, 681

See application file for complete search history.

(56) References Cited

U.S. PATENT DOCUMENTS

| | | | | |
|---|---|---|---|---|
| 4,790,763 | A | 12/1988 | Weber et al. | |
| 6,302,745 | B1 | 10/2001 | Landis et al. | |
| 7,264,517 | B1 | 9/2007 | Piromalli | |
| 7,331,828 | B2 | 2/2008 | Allison | |
| 7,442,093 | B2 | 10/2008 | Li et al. | |
| 7,491,092 | B2 | 2/2009 | Zhu et al. | |
| 8,062,053 | B2 * | 11/2011 | Dooley et al. | 439/354 |
| 2010/0087100 | A1 | 4/2010 | De Blieck et al. | |

* cited by examiner

*Primary Examiner* — Gary F. Paumen
(74) *Attorney, Agent, or Firm* — Sughrue Mion, PLLC

(57) ABSTRACT

A power connector includes an insulative housing, a power contact retained in the insulative housing, a locking member formed on the insulative housing and a key member. The key member includes a retaining portion fixed in the insulative housing and a protrusion extending along a lengthwise direction of the insulative housing. The locking member locks the key member in a mounting hole of the insulative housing. The locking member includes a locking arm. The locking arm is accessible from outside of the insulative housing to thereby release the key member from the insulative housing.

20 Claims, 11 Drawing Sheets

POWER CONNECTOR WITH IMPROVED LOCKING MEMBER EXPOSED TO THE EXTERIOR

CROSS-REFERENCE TO RELATED APPLICATION

This application is a Continuation Application of U.S. patent application Ser. No. 12/939,027, filed Nov. 3, 2010, and entitled "POWER CONNECTOR WITH IMPROVED LOCKING MEMBER EXPOSED TO THE EXTERIOR", which has the same assignee as the present invention, the disclosure which is incorporated herein by reference in its entirety.

BACKGROUND OF THE INVENTION

1. Field of the Invention

The present invention relates to a power connector, and more particularly to a power connector with an improved locking member exposed to the exterior for easy separation.

2. Description of Related Art

Power connectors are usually required to have characteristics of enduring heavy electric current and high voltage. However, when the power connectors are mounted to a system device, it is sometimes difficult for single parts of the power connectors to identify multiple voltages and electric current, because the system device works under different input/output voltage and different electric current. In order to resolve this problem, key members are developed by designers and used in power connectors for ensuring right mating with complementary power connectors.

U.S. Patent Publication No. 2010/0087100A1 published to De Blieck et al. on Apr. 8, 2010 discloses such a power connector including an insulative housing, a plurality of contacts fixed in the insulative housing and a key member. Referring to FIG. 2 of this patent publication, the key member includes a middle portion, a pair of locking arms extending backwardly from the middle portion, and a protrusion extending forwardly from the middle portion. The insulative housing defines a mounting hole for assembly of the key member. However, once the locking arms are assembled to the insulative housing, it is difficult to separate them from the mounting hole, because the locking arms are hidden in the insulative housing. As a result, it is difficult to replace the key member when it is damaged or need to be changed.

Hence, a power connector with improved locking member is desired.

BRIEF SUMMARY OF THE INVENTION

The present invention provides A power connector includes an insulative housing, a power contact retained in the insulative housing, a locking member formed on the insulative housing and a key member. The key member includes a retaining portion fixed in the insulative housing and a protrusion extending along a lengthwise direction of the insulative housing. The locking member locks the key member in a mounting hole of the insulative housing. The locking member includes a locking arm. The locking arm is accessible from outside of the insulative housing to thereby release the key member from the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
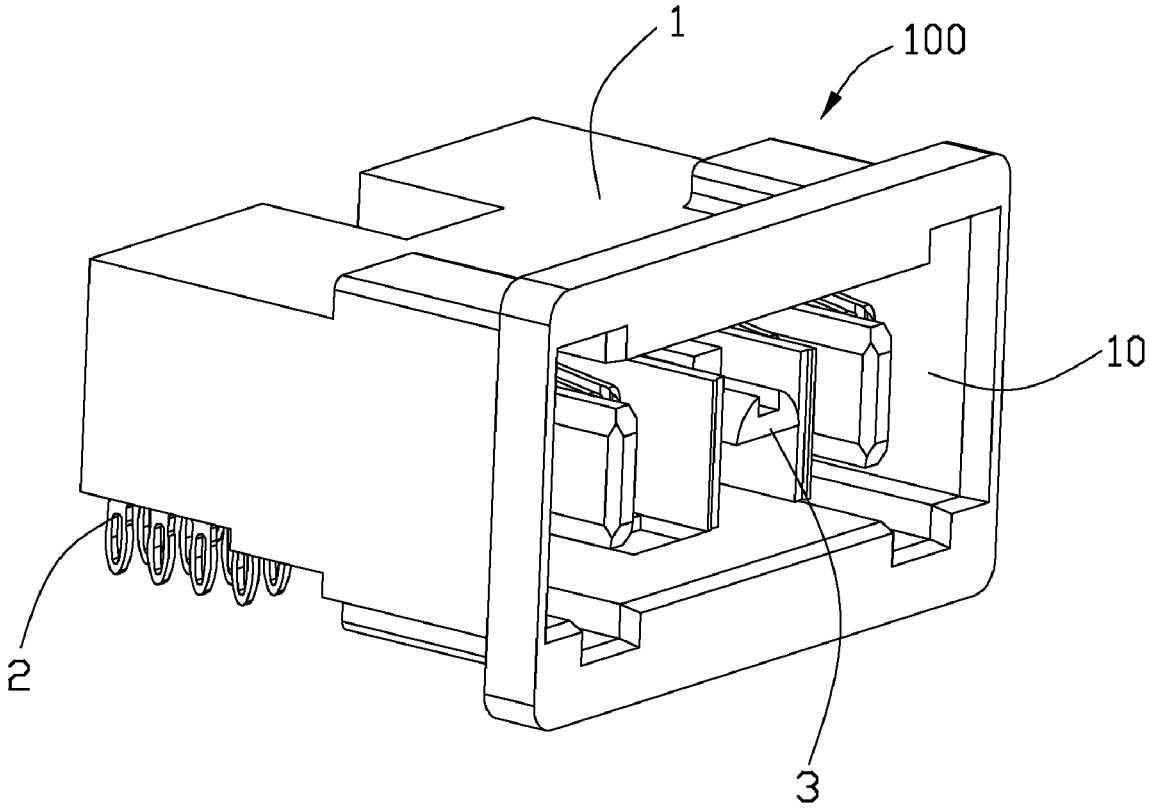
FIG. 1 is a perspective view of a power connector in accordance with an embodiment of the present invention.
Figure 2:
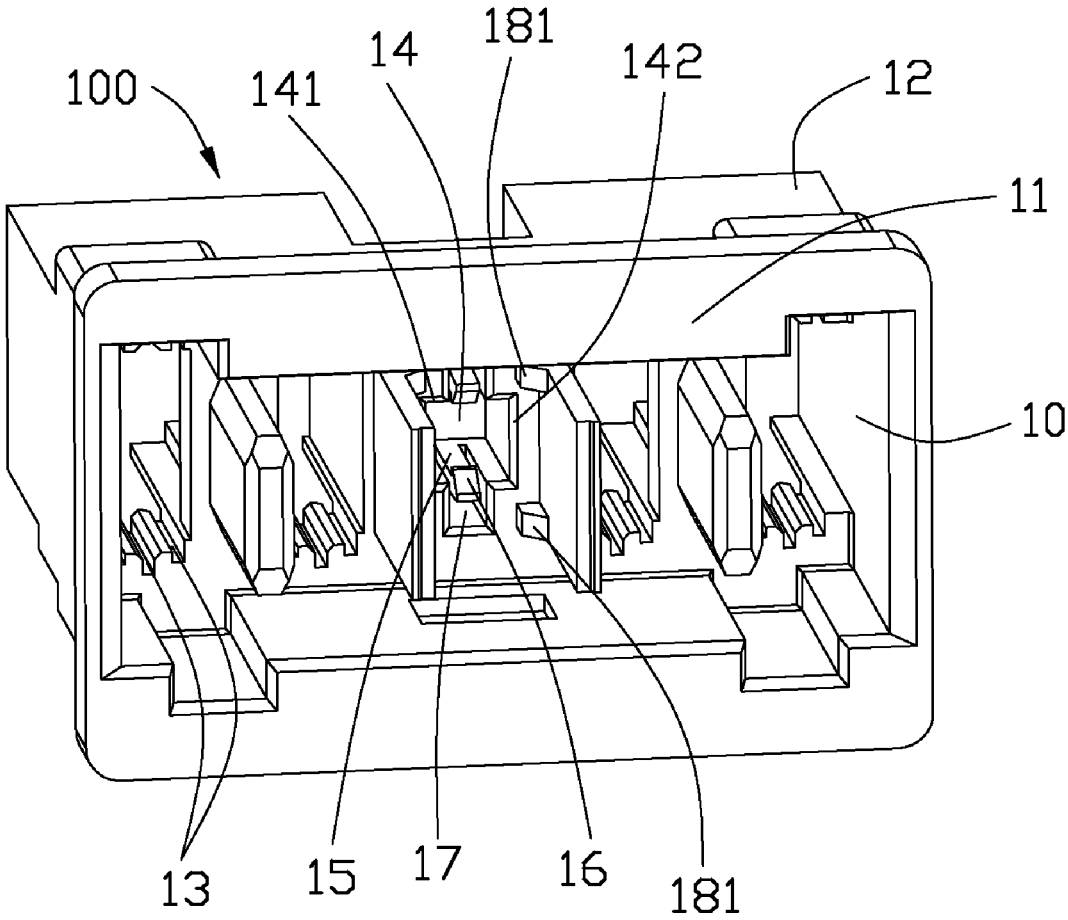
FIG. 2 is a perspective view of the power connector similar to FIG. 1, while taken from another aspect.
Figure 3:
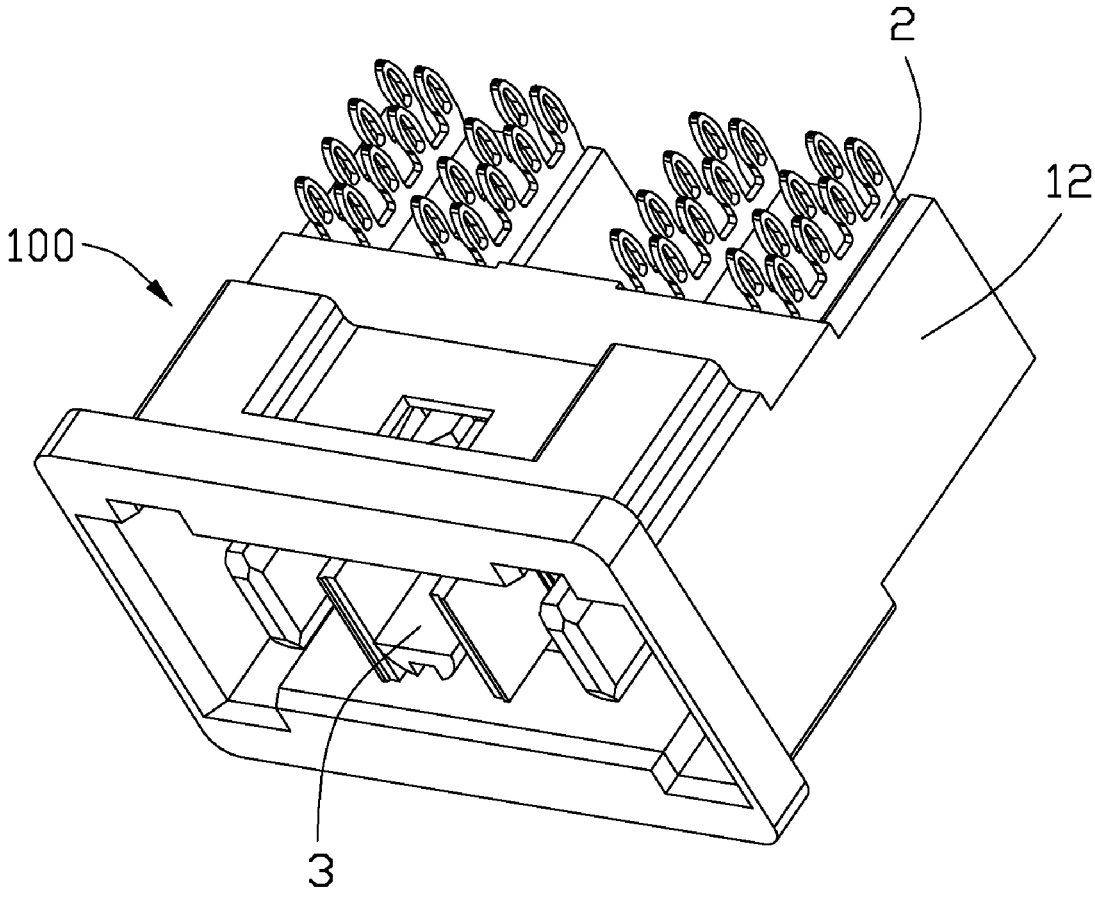
FIG. 3 is another perspective view of the power connector, but viewed from another aspect.

Reference will now be made to the drawing figures to describe the preferred embodiment of the present invention in detail. FIGS. 1 to 3 illustrate a power connector 100 including an insulative housing 1, a plurality of power contacts 2 retained in the insulative housing 1 and a key member 3 assembled to the insulative housing 1 along a front-to-rear direction. The key member 3 is adapted for ensuring right mating with a mating connector (not shown).

Figure 7:
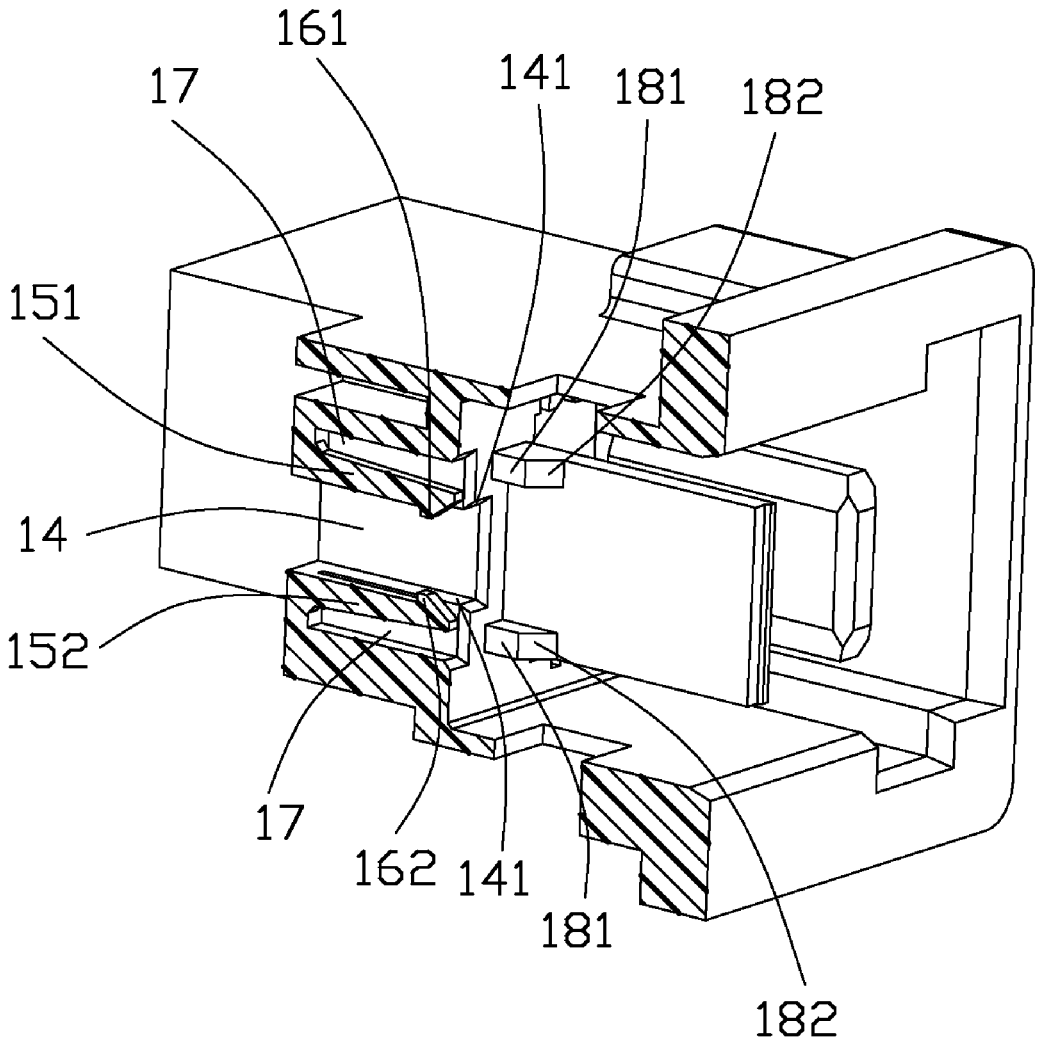
FIG. 7 is a part perspective view of an insulative housing of the power connector as shown in FIG. 1.
Figure 8:
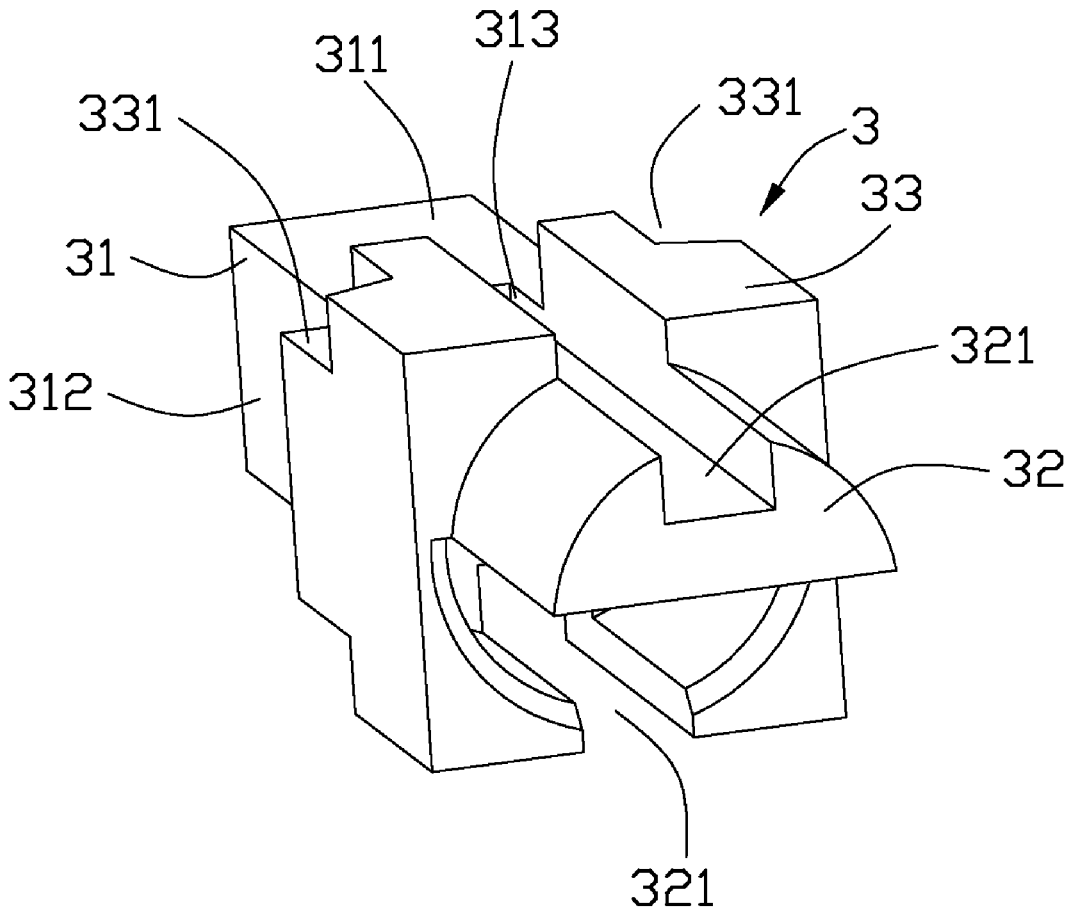
FIG. 8 is a perspective view of a key member of the power connector.
Figure 9:
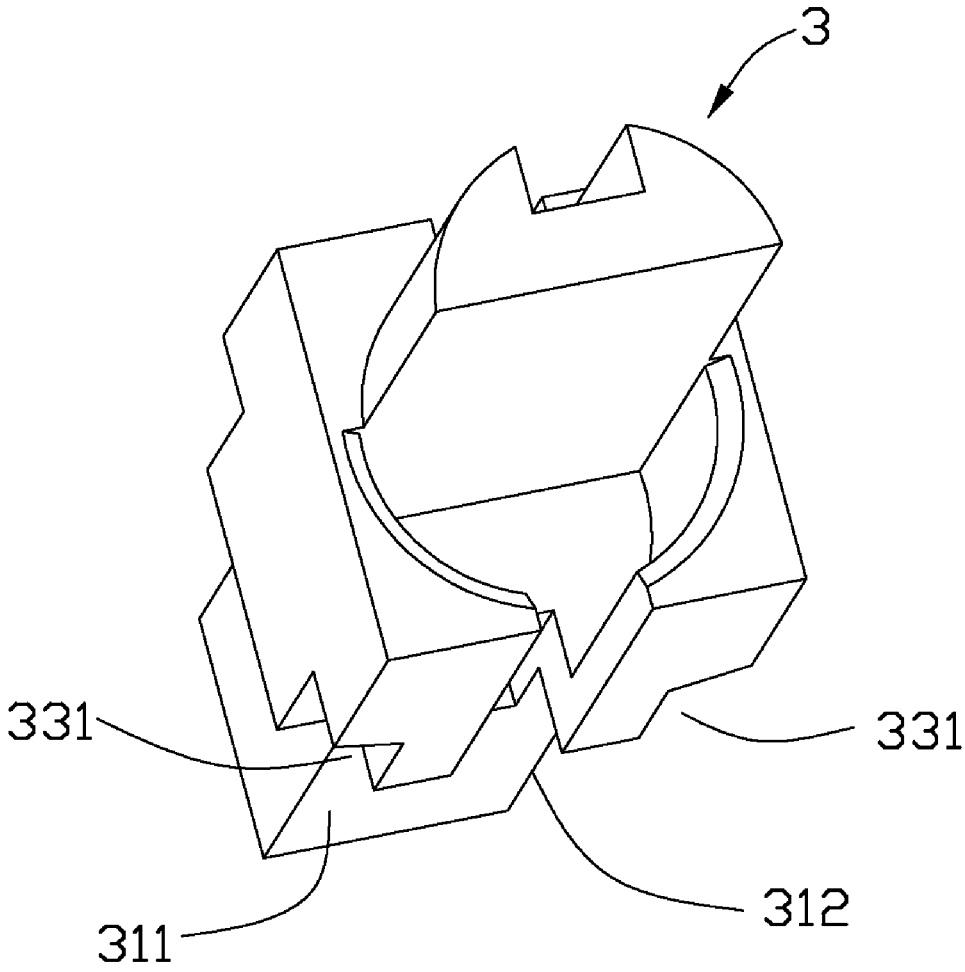
FIG. 9 is another perspective view of the key member, while taken from another aspect.
Figure 10:
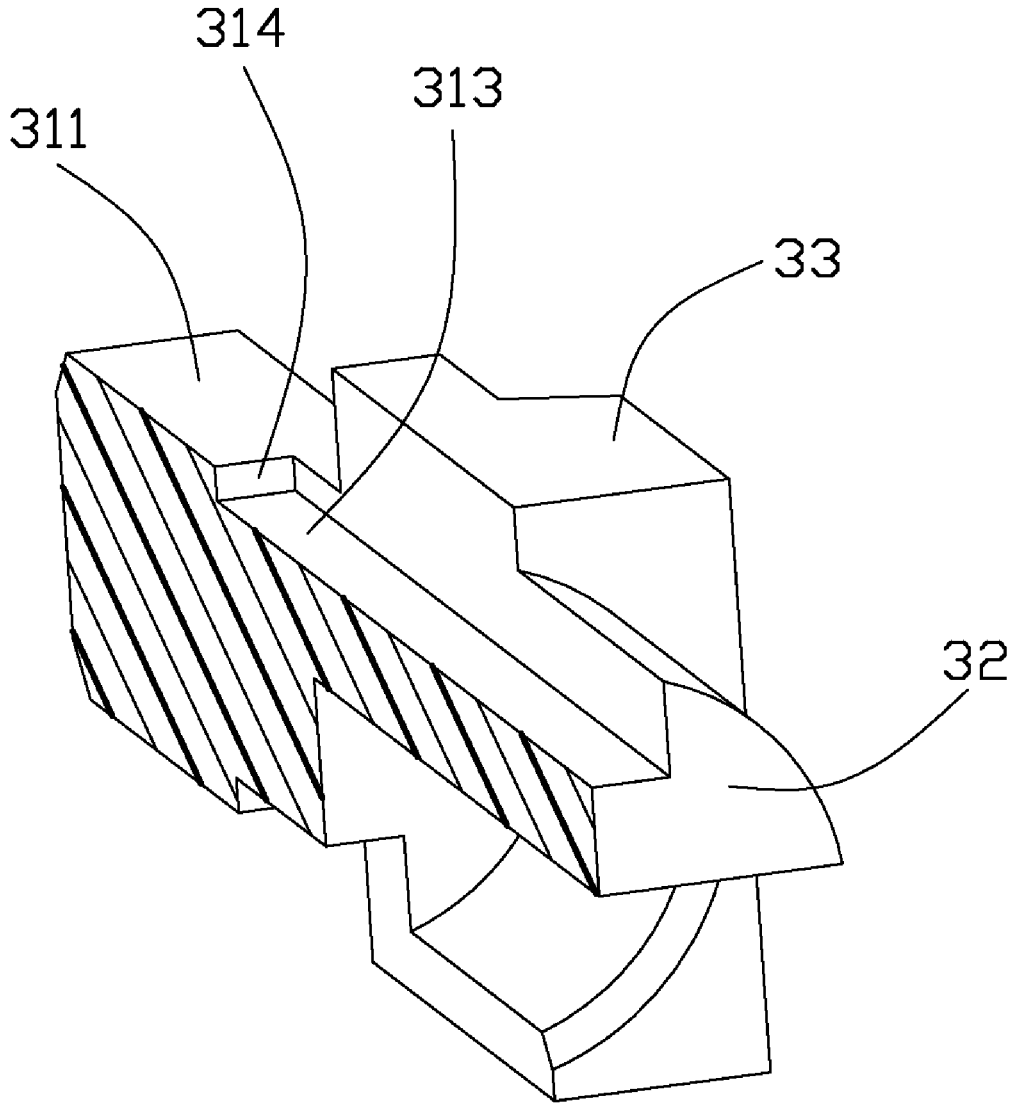
FIG. 10 is a part perspective view of the key member which has been partly removed.
Figure 11:
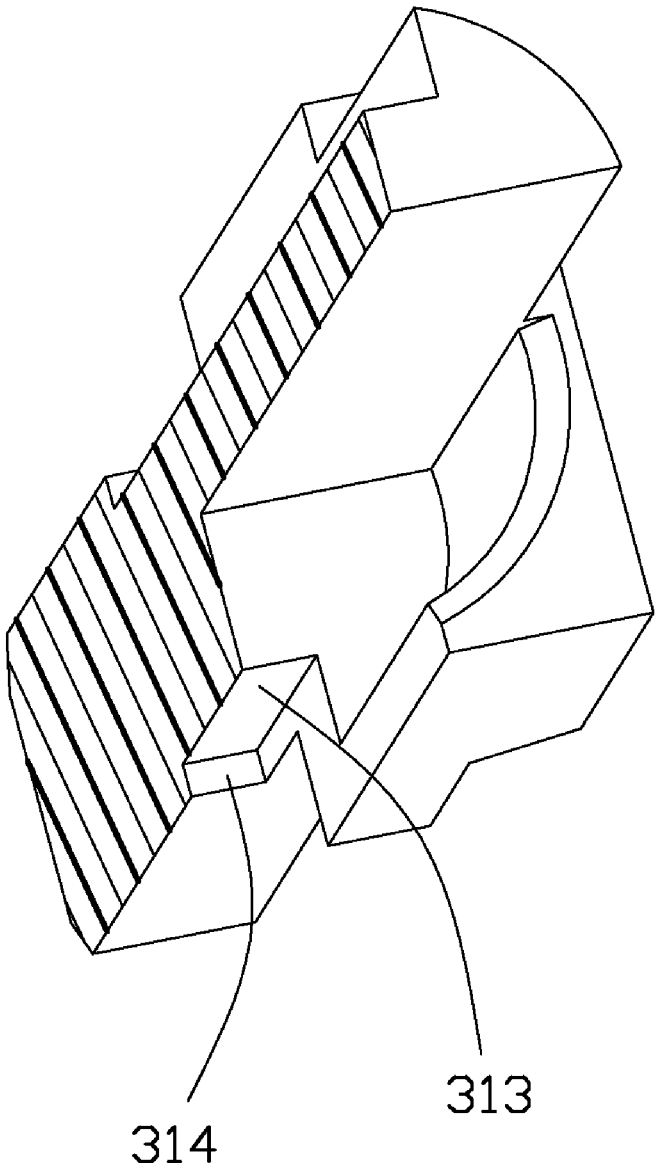
FIG. 11 is another part perspective view of the key member, but viewed from another aspect.

Referring to FIG. 2, the insulative housing 1 includes a mating face 11, a receiving chamber 10 recessed from the mating face 11 for accommodating the mating connector, and a rear portion 12 located at the rear of the receiving chamber 10. The rear portion 12 defines a plurality of passageways 13 extending therethrough along the front-to-rear direction for receiving the power contacts 2. A mounting hole 14 is defined through the rear portion 12 for receiving the key member 3. The mounting hole 14 is in communication with the receiving chamber 10. Besides, the rear portion 12 includes a locking member 15 which includes a locking hook 16 protruding into the mounting hole 14 for locking with the key member 3. Referring to FIG. 7, according to the preferred embodiment of the present invention, the locking member 15 includes a first locking arm 151 and a second locking arm 152 located under the first locking arm 151. The locking hook 16 includes a first hook 161 formed at a distal end of the first locking arm 151, and a second hook 162 formed at a distal end of the second locking arm 152. The rear portion 12 defines a pair of deformation spaces 17 communicating with the first and the second locking arms 151, 152, respectively, for elastic deformation of the first and the second locking arms 151, 152.

Figure 4:
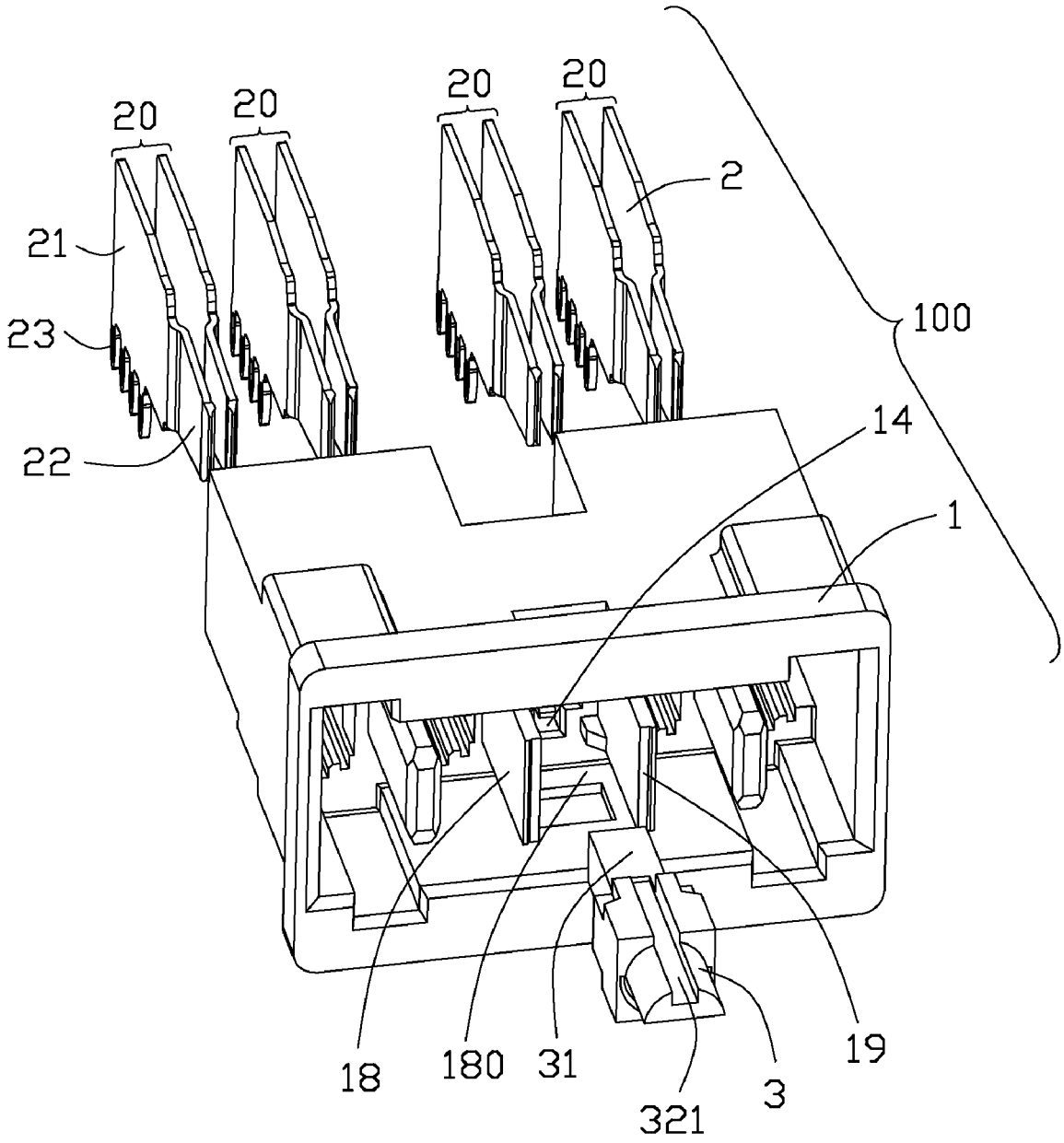
FIG. 4 is an exploded view of the power connector as shown in FIG. 2.
Figure 5:
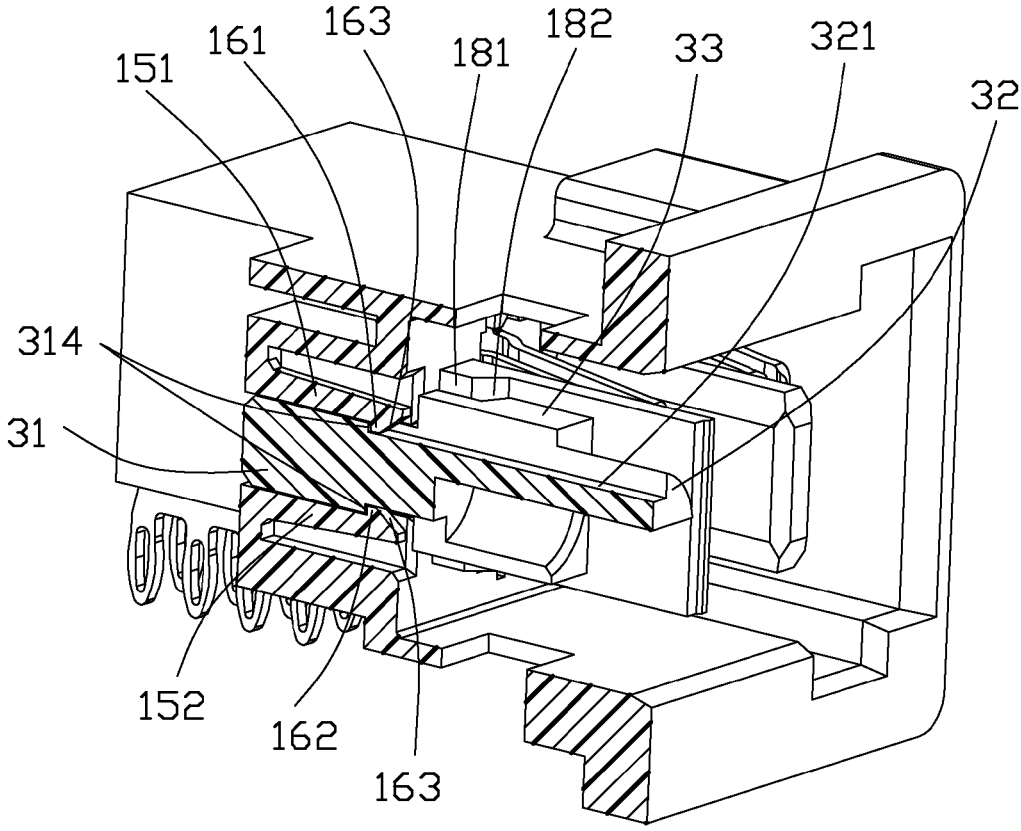
FIG. 5 is a part perspective view of the power connector as shown in FIG. 1 when part of the power connector has been cut out.

Referring to FIG. 4, the insulative housing 1 includes a pair of guiding plates 18, 19 protruding into the receiving chamber 10. The pair of guiding plates 18, 19 are located at opposite sides of the mounting hole 14 and define a guiding passageway 180 in communication with the mounting hole 14 in order to guide insertion of the key member 3 into the mounting hole 14. The pair of guiding plates 18, 19 are mainly located in parallel vertical planes. As shown in FIGS. 2, 5 and 7, each guiding plate 18, 19 includes a pair of upper and lower blocks 181 to restrict the key member 3 along a vertical direction. Each block 181 includes an inclined guiding surface 182 for guiding insertion of the key member 3.

Referring to FIG. 2, the mounting hole 14 is polygonal and is configured to receive the key member 3 in order to prevent relative rotary of the key member 3 and the mounting hole 14. According to the preferred embodiment of the present invention, the mounting hole 14 is rectangular and is restricted by a pair of flat and opposite first locating surfaces 141 and a pair of flat and opposite second locating surfaces 142 which are perpendicular to the first locating surfaces 141. As shown in FIG. 7, the first and the second hooks 161, 162 extend beyond the first locating surfaces 141 and into the mounting hole 14.

Referring to FIG. 4, each power contact 2 is flat for easy manufacture and includes a fixation portion 21 retained in the corresponding passageway 13, a contacting portion 22 extending from the fixation portion 21 into the receiving chamber 10, a plurality of mounting tails 23 downwardly extending from the fixation portion 21 for being mounted to a PCB. Adjacent power contacts 2 consist of a contact pair 20 for mating with the mating connector. In each contact pair 20, a space between adjacent contacting portions 22 is smaller than that between adjacent fixation portions 21.

Referring to FIGS. 8 to 11, the key member 3 includes a retaining portion 31 received in the mounting hole 14, a protrusion 32 protruding into the receiving chamber 10, and a middle portion 33 connecting the retaining portion 31 and the protrusion 32. The outer surfaces of the retaining portion 31 are polygonal and configured to be received in the mounting hole 14. According to the preferred embodiment of the present invention, the retaining portion 31 is rectangular and comprises a pair of flat and opposite first mating surfaces 311 and a pair of flat and opposite second mating surfaces 312 which are perpendicular to the first mating surfaces 311. A pair of upper and lower slots 313 are recessed from the first mating surfaces 311 in order to form a pair of vertical locking surfaces 314. Besides, a pair of slits 321 are formed in communication with the slots 313 and extend forwardly through a distal end of the protrusion 32. The middle portion 33 is wider and higher than the retaining portion 31 and the protrusion 32. Besides, a plurality of cutouts 331 are formed at four corners of the middle portion 33.

As shown in FIG. 5, each of the first and the second hooks 161, 162 includes an inclined surface 163 exposed to the corresponding slits 321 and the receiving chamber 10. The first and the second locking arms 151, 152 are outwardly deformable in the deformation spaces 17 when the inclined surfaces 163 are pushed by a tool (not shown). The tool can be provided with a pair of parallel beams (not shown) extending horizontally along the front-to-rear direction. As a result, the first and the second hooks 161, 162 unlock with the vertical locking surfaces 314.

Figure 6:
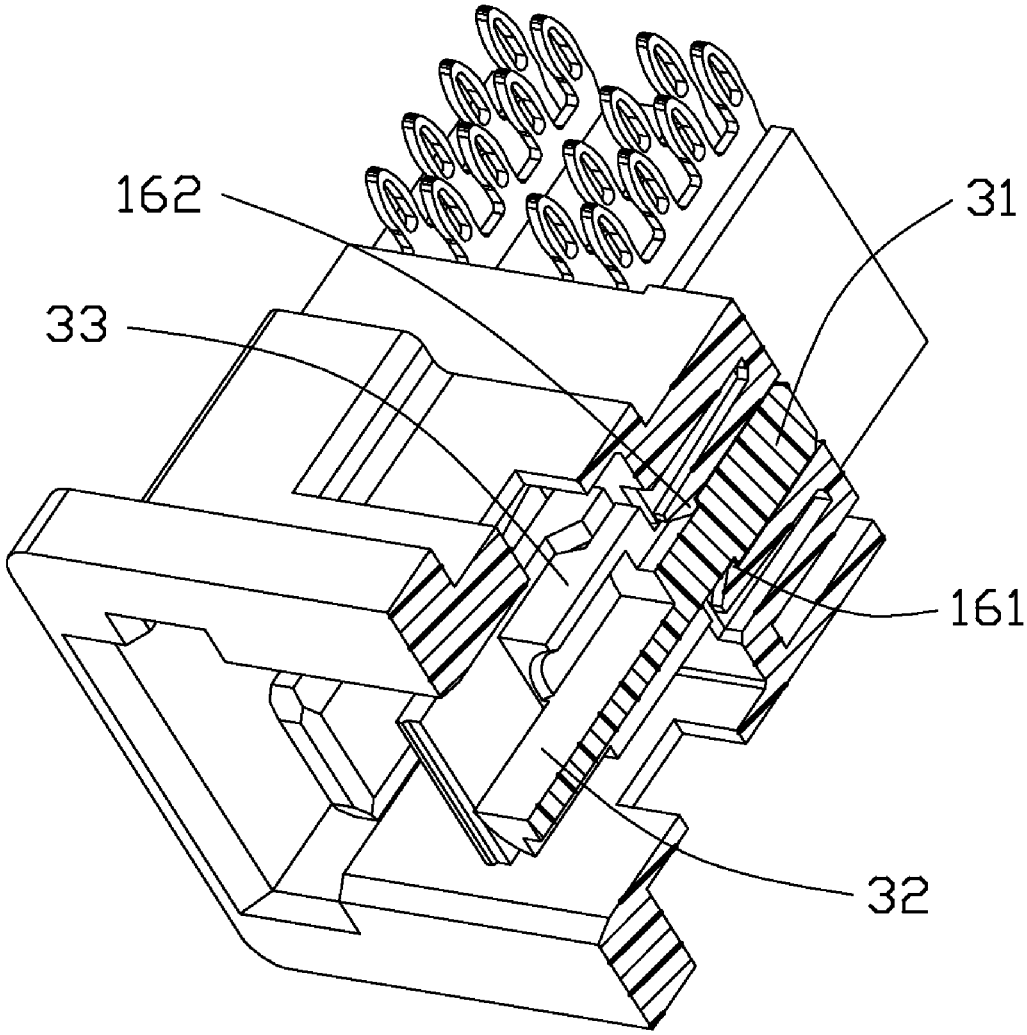
FIG. 6 is another part perspective view of the power connector as shown in FIG. 3 when part of the power connector has been cut out.

Referring to FIGS. 4 to 6, when the key member 3 is assembled to the insulative housing 1, the retaining portion 31 of the key member 3 is guided by the pair of guiding plates 18, 19. The first and the second mating surfaces 311, 312 are received in the mounting hole 14 along the first and the second locating surfaces 141, 142, respectively. In such process, the first and the second mating surfaces 311, 312 press against the first and the second hooks 161, 162, respectively, so that the first and the second locking arms 151, 152 are deformable in the deformation spaces 17. When the key member 3 is inserted to reach the final position, the first and the second hooks 161, 162 are released to protrude into the slots 313. Under this condition, the first and the second hooks 161, 162 abut against the vertical locking surfaces 314 in order to prevent the retaining portion 31 from withdrawing from the mounting hole 14. The retaining portion 31 is jointly clipped by the first and the second locking arms 151, 152. Besides, the pair of first and the second hooks 161, 162 compared with one hook can reinforce the retaining portion 31 received in the mounting hole 14. The blocks 181 of the guiding plates 18, 19 are received in the cutouts 331 of the middle portion 33.

Since the rectangular retaining portion 31 is received in the rectangular mounting hole 14 with the first and the second mating surfaces 311, 312 abutting against the first and the second locating surfaces 141, 142, relative larger and stronger pressing surfaces can be provided. Such pressing surfaces can endure big torque in order to prevent the rotary of the retaining portion 31 with respect to the mounting hole 14. Besides, when the key member 3 rotates 90 or 180 degrees, it can still be inserted into the mounting hole 14. As a result, different mounting positions of the same key member 3 can be realized.

Because the first and the second hooks 161, 162 are horizontally and forwardly exposed to the exterior through the slits 321, it is obvious that the tool can be easily inserted into the slits 312 to push the inclined surfaces 163. With the beams of the tool inserted into the slits 312, the first and the second locking arms 151, 152 are outwardly driven as a result that the first and the second hooks 161, 162 unlock with the retaining portion 31. According to the present invention, the key member 3 can be easily taken off from the mounting hole 14 by using the tool. It is sufficient when the key member 3 is broken and needed to be replaced, or the key member 3 is needed to rotate a certain degree for multiple usage.

As can be understood, however, the locking member can also be formed on the key member for locking the key member in the insulative housing. The hooks of the locking member extend away from each other. The tool can be access from a back side of the insulative housing to thereby release the key member together with the locking member from the insulative housing.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power connector comprising:

an insulative housing;

at least one power contact assembled to said insulative housing;

a key member comprising a retaining portion fixed in said insulative housing and a protrusion extending along a lengthwise direction of said insulative housing; and a locking member locking said key member in said insulative housing, said locking member comprising a locking arm, said locking arm being accessible from outside of said insulative housing to release said key member from said insulative housing.

2. The power connector as claimed in claim 1, wherein said locking member is integratedly formed on said insulative housing with said locking arm being lockable with said retaining portion of said key member.

3. The power connector as claimed in claim 2, wherein said insulative housing defines a mounting hole where said locking member and said key member are locked with each other.

4. The power connector as claimed in claim 3, wherein said mounting hole is polygonal and is configured to receive said retaining portion of said key member in order to prevent undesired rotary of the retaining portion with respect to said mounting hole.

5. The power connector as claimed in claim 4, wherein said mounting hole is restricted by a first locating surface and a second locating surface, said retaining portion of said key member comprising first and second mating surfaces abutting against said first and said second locating surfaces, respectively.

6. The power connector as claimed in claim 2, wherein said locking member comprises a pair of locking arms, by which said key member is jointly clipped from opposite sides thereof.

7. The power connector as claimed in claim 6, wherein each of said locking arms comprises a hook protruding into said mounting hole, and wherein said pair of hooks are extending toward each other.

8. The power connector as claimed in claim 7, wherein said protrusion of said key member defines a slit thereon from which one of said hooks is exposed to outside.

9. The power connector as claimed in claim 3, wherein said insulative housing defines a receiving chamber and a pair of guiding plates protruding into said receiving chamber, said pair of guiding plates being located at opposite sides of said mounting hole and defining a guiding passageway in communication with said mounting hole in order to guide insertion of said retaining portion into said mounting hole.

10. The power connector as claimed in claim 9, wherein said key member comprises a middle portion connecting said retaining portion and said protrusion, said pair of guiding plates being located in parallel vertical planes, and wherein each guiding plate comprises an upper block and a lower block to restrict said middle portion between said upper and said lower blocks along a vertical direction.

11. The power connector as claimed in claim 1, wherein said locking member is formed on said key member and is lockable within said insulative housing.

12. The power connector as claimed in claim 11, wherein said locking member comprises a pair of locking arms, each of said locking arms providing a hook, and wherein said pair of hooks are extending away from each other.

13. The power connector as claimed in claim 1, wherein said locking member provides a deformation space besides said locking arm.

14. The power connector as claimed in claim 7 or 12, wherein said hook is formed on a distal end of said locking arm and provides an inclined surface thereon.

15. The power connector as claimed in claim 2 or 11, wherein said insulative housing comprises a mating face and a receiving chamber opened from said mating face.

16. The power connector as claimed in claim 15, wherein said at least one power contact forms a contact portion extending within said receiving chamber.

17. A power connector comprising:

an insulative housing, said insulative housing comprising a mating face, a receiving chamber opened from said mating face, and a mounting hole communicating with said receiving chamber;

a plurality of power contacts assembled to said insulative housing;

a key member comprising a middle portion, a retaining portion and a protrusion, said retaining portion connected with one side of said middle portion and protruding into said mounting hole, said protrusion connected with opposite side of said middle portion; and a pair of locking arms, each of said locking arms comprising a hook located beside said retaining portion of said key member for locking said key member in said insulative housing.

18. The power connector as claimed in claim 17, wherein said locking arms being deformable in a deformation space provided on said insulative housing.

19. The power connector as claimed in claim 18, wherein said insulative housing defines a pair of guiding plates being located at opposite sides of said mounting hole and defining a guiding passageway in communication with said mounting hole in order to guide insertion of said retaining portion into said mounting hole, each guiding plate comprising an upper block and a lower block to restrict said middle portion between said upper and said lower blocks.

20. The power connector as claimed in claim 19, wherein each said power contact is flat and includes a fixation portion retained in said insulative housing, a contacting portion extending from said fixation portion into said receiving chamber, and a plurality of mounting tails extending from said fixation portion.

* * * * *